US006150957A

United States Patent [19]

Henz et al.

[11] Patent Number: 6,150,957

[45] Date of Patent: Nov. 21, 2000

[54] LIGHTED SIGN AND WARNING DEVICE

[76] Inventors: Richard M. Henz, Rte. 4, Box 290, Rushville, Ill. 62681; Phillip C. Layne, Rte. 3, Box 170B, Rushville, Ill. 62681

[21] Appl. No.: 09/349,561

[22] Filed: Jul. 8, 1999

Related U.S. Application Data

[60] Provisional application No. 60/092,395, Jul. 10, 1998.

[51] Int. Cl.[7] ..... G08G 1/095

[52] U.S. Cl. ..... 340/908; 340/908.1; 340/321

[58] Field of Search ..... 340/908, 908.1, 340/321, 473, 691.6, 691.3, 693.2, 322; 116/DIG. 36, 202; 40/586

[56] References Cited

U.S. PATENT DOCUMENTS

| | | | |
|---|---|---|---|
| 4,042,919 | 8/1977 | Patty | 340/321 |
| 5,276,424 | 1/1994 | Hegemann | 340/321 |
| 5,422,638 | 6/1995 | Singer et al. | 340/908.1 |
| 5,442,870 | 8/1995 | Kochanowski | 40/582 |
| 5,687,500 | 11/1997 | Lamparter | 40/572 |
| 5,694,110 | 12/1997 | Clifford . | |
| 5,755,051 | 5/1998 | Zumbuhl | 40/586 |

*Primary Examiner*—Jeffery A. Hofsass
*Assistant Examiner*—Daniel Previl
*Attorney, Agent, or Firm*—Husch & Eppenberger, LLC; Robert E. Muir

[57] ABSTRACT

The invention describes a lighted traffic control device which can be used to warn approaching motorists to areas of road construction or repair. Traffic control is very important at construction and repair sites, because laborers are working in close proximity to moving vehicles. A sign that can be remotely operated to display various traffic signals, such as "SLOW" or "STOP", eliminates the need for a worker to operate such a multi-faced sign near oncoming traffic. The device consists of a mobile base with a telescoping pole supporting a multi-faced traffic control sign. Outriggers level the base and prevent unwanted movement. A strobe light attracts the attention of approaching motorists at a sufficient distance to provide adequate warning, while also illuminating the face of the sign. The light is powered by a sufficiently large battery so as to operate for long periods of time. A servo motor located on the base may be remotely operated to rotate the pole so that the face of the sign displayed to traffic can be changed as required.

24 Claims, 8 Drawing Sheets

LIGHTED SIGN AND WARNING DEVICE

PRIORITY

This application claims the benefit of U.S. Provisional Application No. 60/092,395 filed Jul. 10, 1998.

BACKGROUND OF THE INVENTION

The present invention relates generally to the field of traffic control devices and more particularly to a lighted sign and warning device.

Traffic control is very important especially at construction sites where workers are laboring in close proximity to moving vehicles. As the interstate highway system ages, more repair and construction is being performed at locations where the speed limit is very high. Accordingly it is important to give motorists warning of the construction area as soon as possible. It is desirable that the warning be visible even under poor visibility conditions. It is also desirable that the warning alert motorists even when there may be other distractions. It is also desirable that the warning device be as versatile and multi-functional as possible.

The use of lighted sign structures is known in the prior art. Examples include U.S. Pat. No. 4,042,919 issued Aug. 16, 1977, to Patty; U.S. Pat. No. 5,276,424 issued Jan. 4, 1994, to Hegemann; U.S. Pat. No. 5,694,110 issued Dec. 2, 1997, to Clifford; and U.S. Pat. No. 5,687,500 issued Nov. 18, 1997, to Lamparter. The first three are hand-held signs and, as such, their battery capacity is limited. The last is mounted on a school bus and uses the bus' power supply; however it is not usable at a construction site.

SUMMARY OF THE INVENTION

An object of the present invention is to provide a lighted sign and warning device which overcomes one or more of the above described deficiencies.

Another object is to provide an all terrain sign which is versatile and multi-functional.

Still another object is to provide a lighted sign and warning device which alerts motorists at a distance and which calls attention to the sign.

Yet another object is to provide a lighted sign and warning device which provides an alert even under poor visibility conditions.

In accordance with the present invention there is provided a lighted sign and warning device which has one or more of the following features:

a sign;

a lighting device in functional communication with the sign;

a base;

at least one wheel mounted to the base; and, a pole mounted on the base supporting the sign.

Other objects and aspects may be perceived from the following description. These, and other objects and advantages of the present invention, will become apparent as the same becomes better understood from the following detailed description when taken in conjunction with the accompanying drawings.

BRIEF DESCRIPTION OF THE DRAWINGS

Reference is now made more particularly to the drawing which illustrate the best presently known mode of carrying out the invention and wherein similar reference characters indicate the same parts throughout the views.

DETAILED DESCRIPTION

Figure 1:
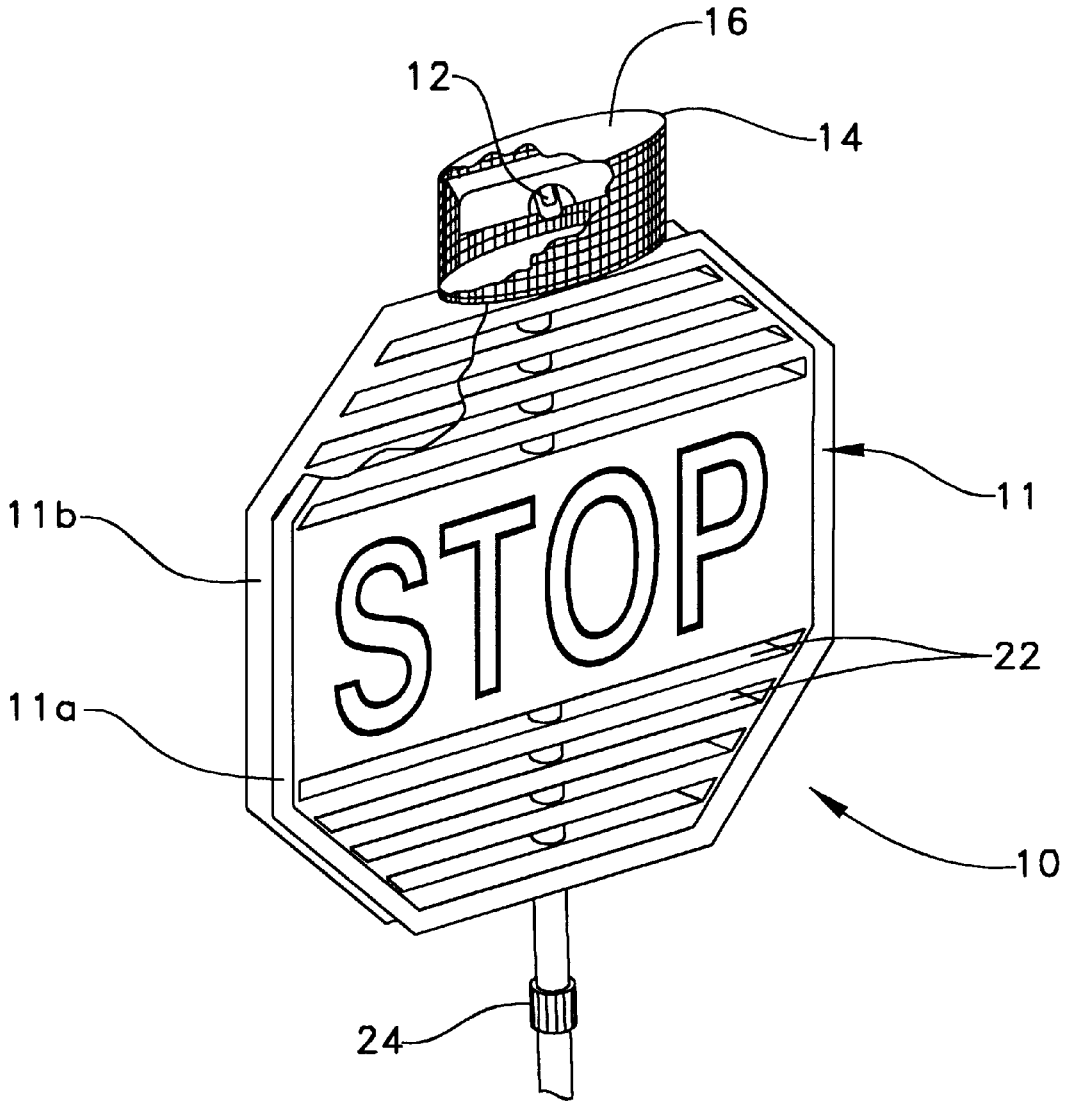
FIG. 1 is a front perspective view showing a pole, a vented sign, and a light affixed atop the sign and with some parts broken away for better illustration.

Reference is now made more particularly to the drawings which illustrate the best presently known mode of carrying out the invention and wherein similar reference characters indicate the same parts throughout the several views.

A preferred embodiment of the invention is an assemblage of FIGS. 1, 2, 5, and 7. The assemblage provides an all-terrain, free-standing, self-supported, lighted sign and warning device, generally designated 10, that is mobile and may be used in road construction, repair, or any traffic-related situation. The device 10 includes a two-faced sign 11 supported on an extendable telescoping pole 13, and a high intensity quad flashing strobe light 12 encased in a removable omnidirectional housing 14. In a preferred embodiment of the invention, the lighting device 12 and sign 11 are enclosed in one housing. The housing 14 contains a metal plate 16 which reflects the strobe light outwardly and downwardly. The light is reflected outwardly to project the light at a great distance to alert motorists and oncoming traffic. The light is reflected downwardly to illuminate the face of the sign 11 which helps to call attention to it and to make it more recognizable and readable. The housing 14 is removably mounted at the top of the sign 11, and the light 12 is plugged into a receptacle (not shown) to connect it to DC power. This upper receptacle is connected to a receptacle 92 near the bottom of the pole by a spiral electrical cord which is enclosed in the extendable pole 13. A battery 20, advantageously a rechargeable 12 volt, 600 amp., deep cycle marine-type battery, is connected by a wire with an electrical plug 94 to this receptacle 92, thus providing power for the light.

Figure 2:
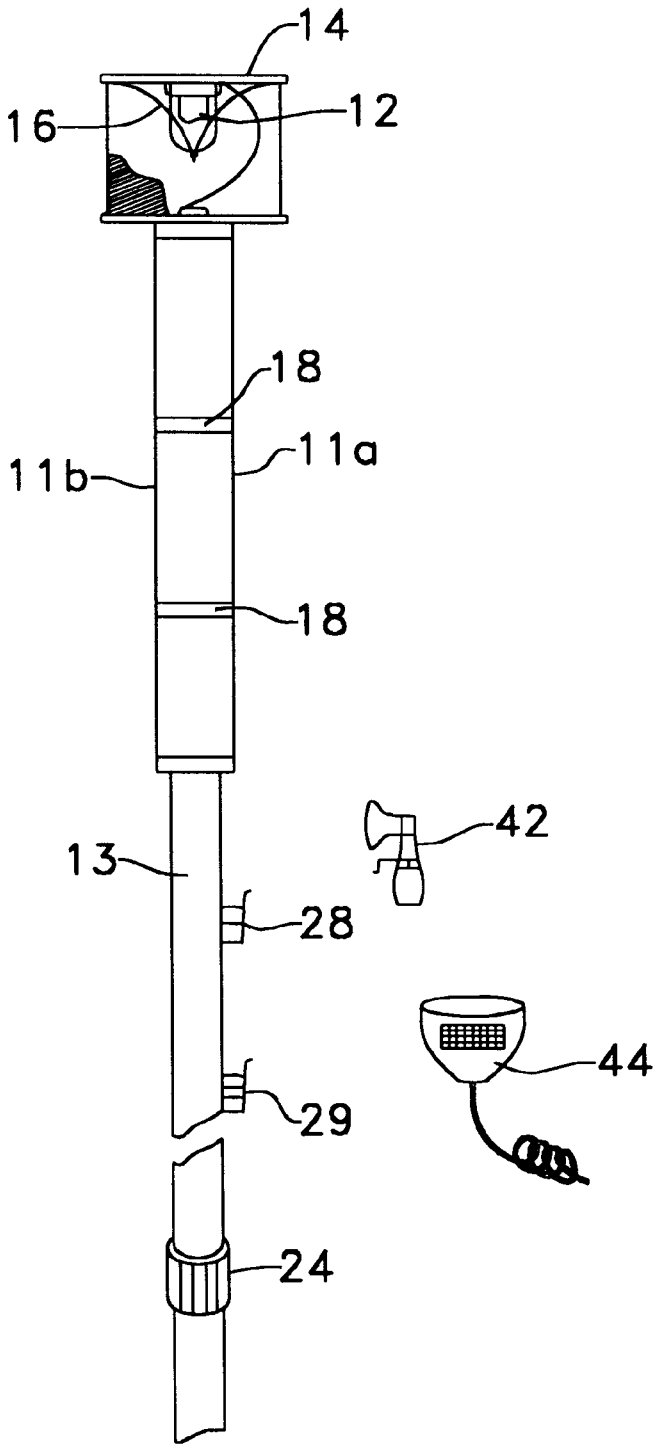
FIG. 2 is a side view showing the pole, sign and light fixture, and clips for accessory attachments.
Figure 3:
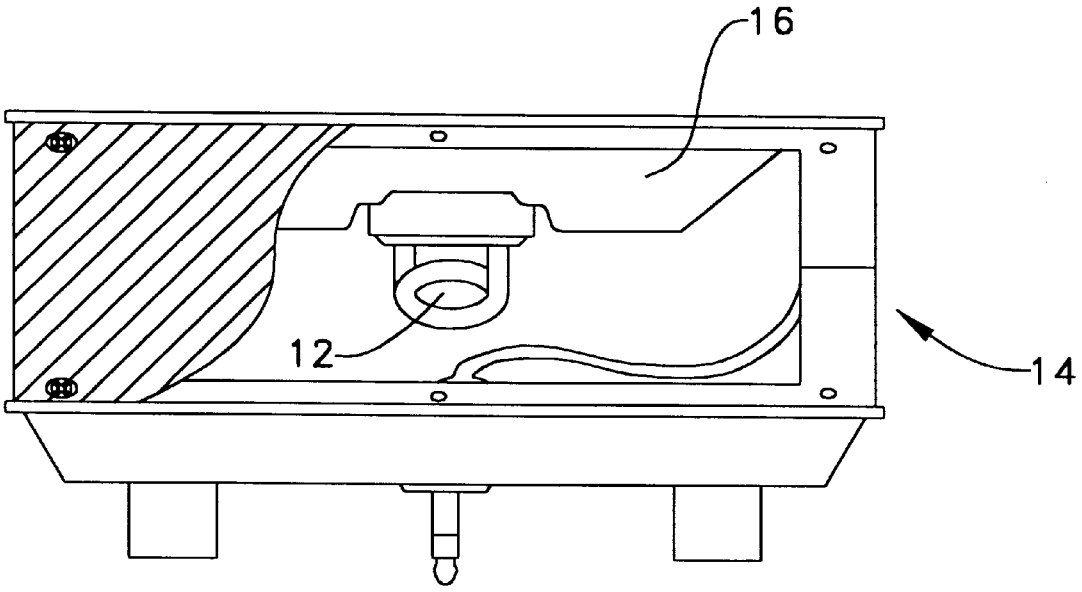
FIG. 3 is a front view of the light fixture with a portion of the transparent cover broken away.
Figure 4:
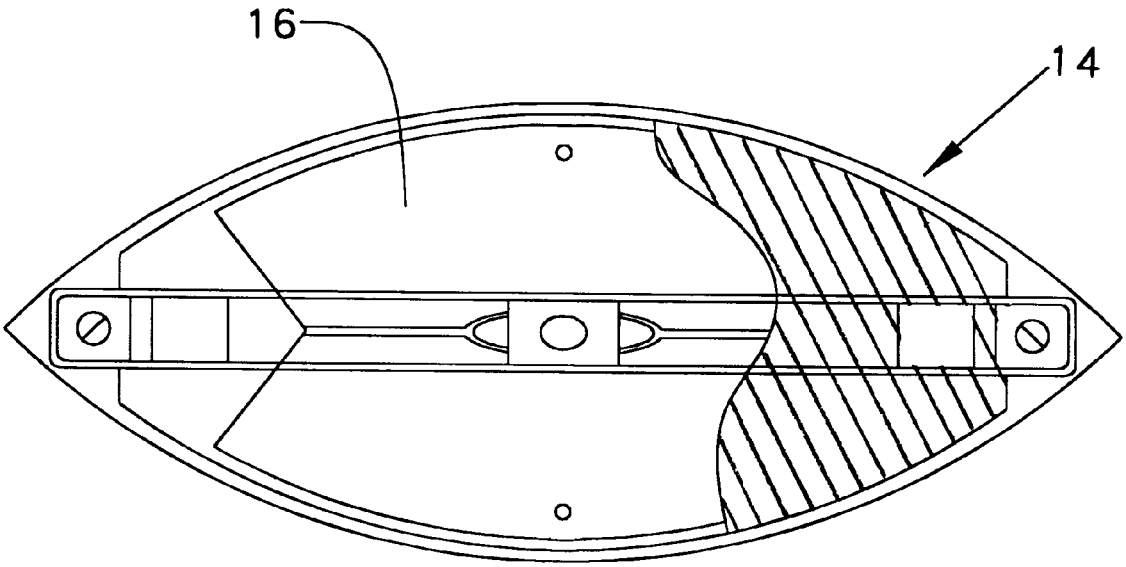
FIG. 4 is a top view of the light fixture with a portion of the top broken away.
Figure 5:
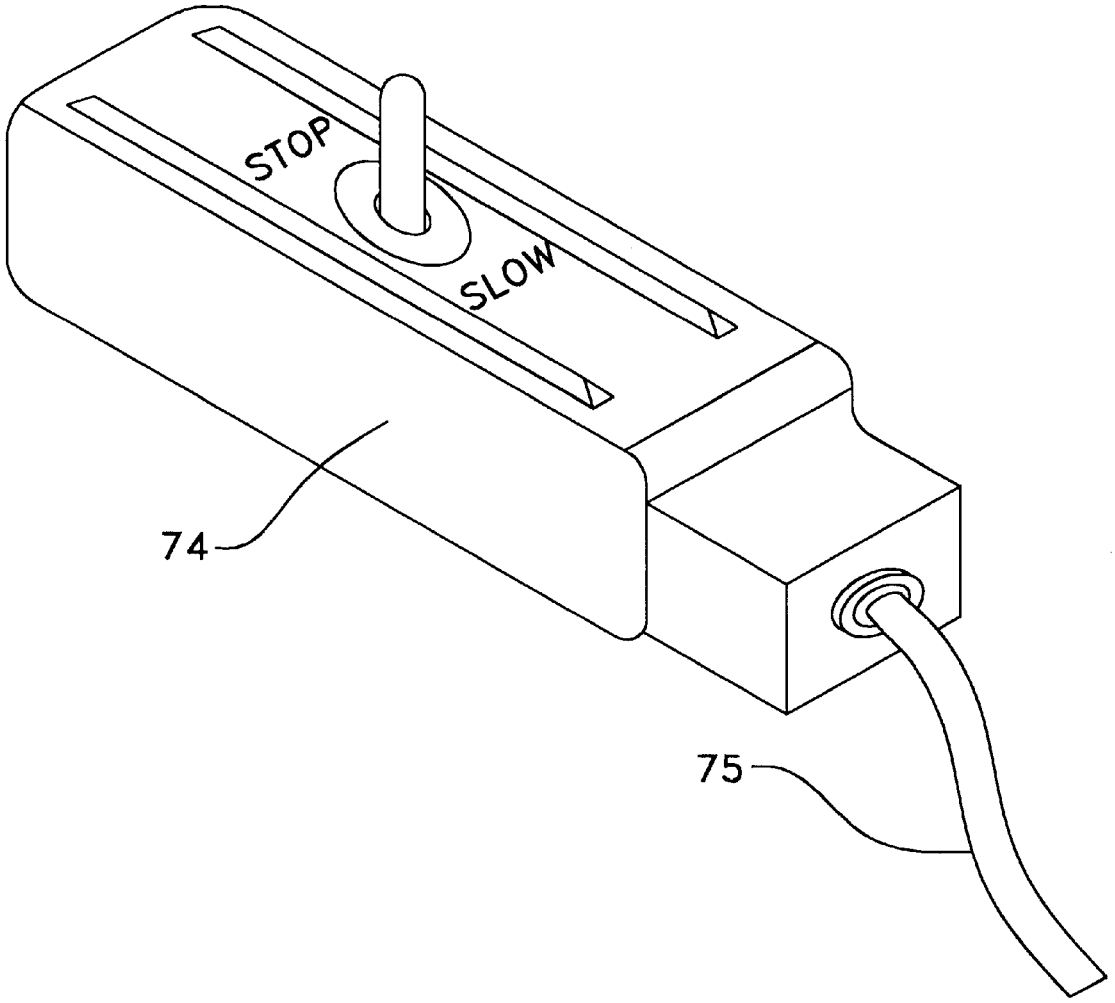
FIG. 5 is a perspective view of a switch for operating the motor.
Figure 6:
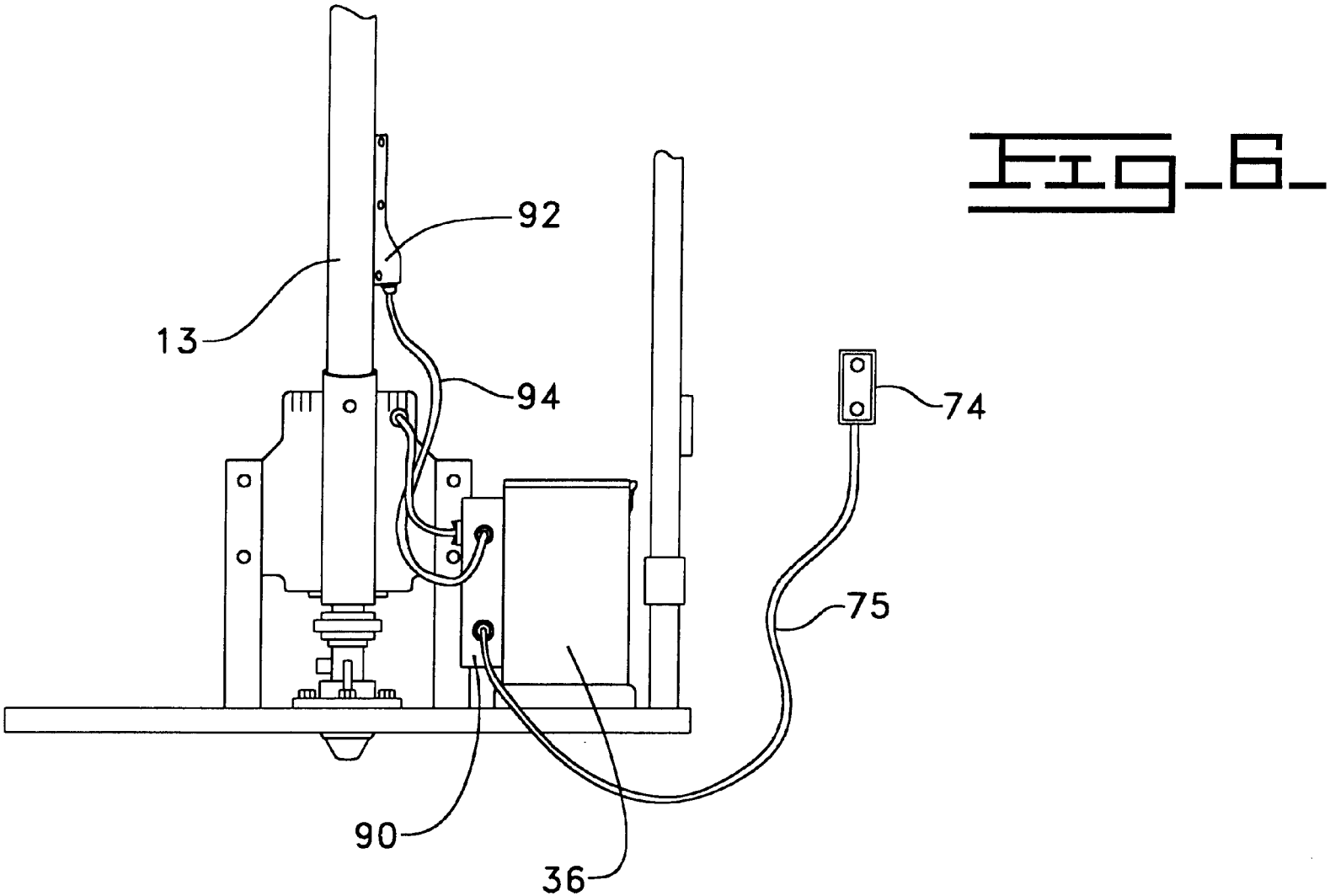
FIG. 6 is a side view of the wiring for the lighting system.
Figure 7:
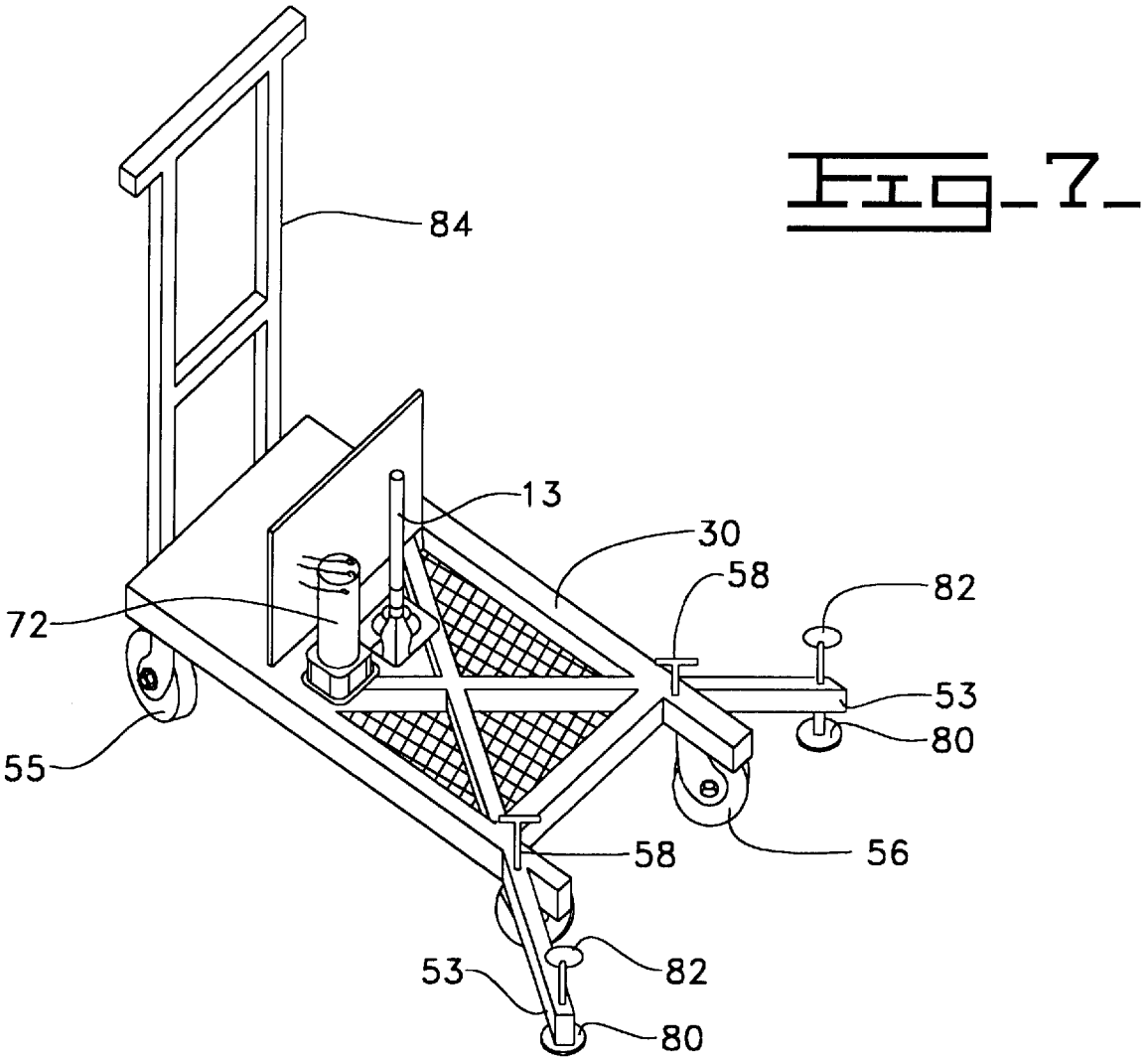
FIG. 7 is a perspective view of the base of the device showing a handle.
Figure 8:
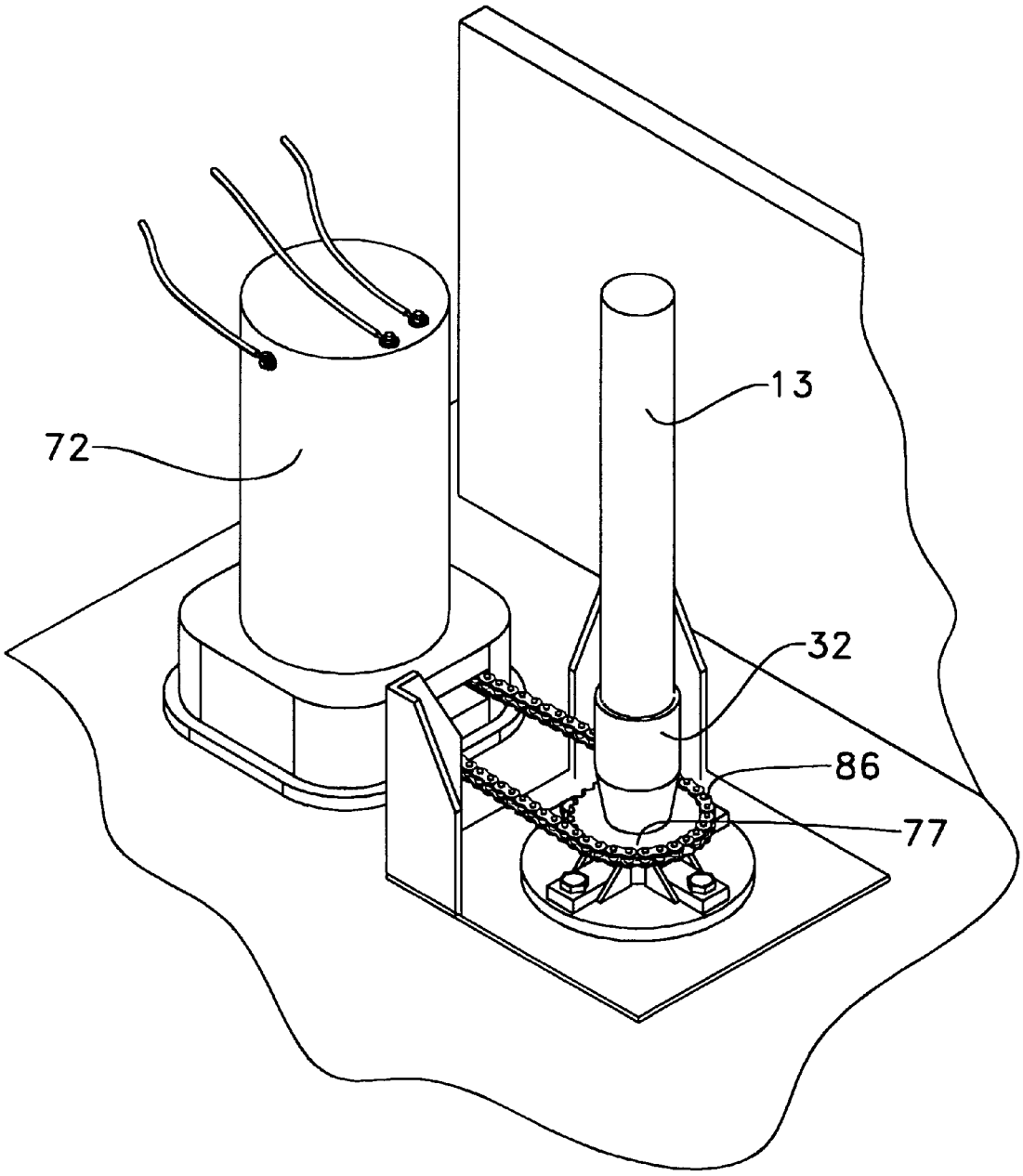
FIG. 8 is a perspective view of the chain used to rotate the pole.

The two-faced sign 11 is formed by two offset vented octagonal sheets 11*a*, 11*b* which are joined by a plurality of ¾ inch nylon spacers 18, best shown in FIG. 2. The vented sign is not part of the invention. Typically one sheet has one message or indicia, such as "STOP", and the other sheet has another, such as "SLOW". The sheets 11*a*, 11*b* have vents 22 which are advantageously horizontal as shown in FIG. 1. The purpose of the vents 22 is to decrease wind resistance. One may use suction cups (not shown) or a pull-down screen (not shown) to change the face of the sign.

The mast or pole 13 has a locking mechanism 24 as is common in telescopic poles. The mast or pole 13 is designed to make a 180° turn. There are two clips 28, 29 attached to the pole 13 to be used for auxiliary items such as an emergency horn 42 or a two-way radio 44 (see FIG. 2).

As described above, the pole 13 fits into the supporting hub 32 which is part of a base, generally designated 30. The base includes a frame 33 supporting a platform 34 which is proportioned for carrying supplies and other auxiliary items, such as safety equipment, tools, clothing, lunch boxes, etc. The frame is advantageously made of square tubular members and has both peripheral members and diagonal members. The platform 34 is advantageously formed of an open grid or expanded metal. Mounted on the platform 34 is a battery case 36 to hold the before-mentioned marine battery 20. The case 36 has external power couplings (not shown) for use with accessories such as the two-way radio 44 and/or a high speed camera (not shown). The case 36 may also carry a solar cell (not shown) mounted on the handle.

The device 10 is designed to be moved and, for this purpose, has several features. There are removable stabilizing outriggers 53 which slide within the diagonal members of the frame 33 and are extendable for stability. While two outriggers 53 have been shown and described, other arrangements are contemplated. The position of each outrigger 53 may be maintained by use of a T-bar pin 58. Each outrigger 53 has an outrigger foot 80, the height of which may be adjusted to level the device 10. The outrigger foot 80 is connected to the outrigger 53 by means of a swivel (not shown). The height of the outrigger feet 80 may be adjusted manually or by using a portable drill. The preferred embodiment of the device allows each outrigger foot 80 to be adjusted by attaching an electric drill to a 9/16" (or any other size of bolt head) adjustment bolt 82 connected to the outrigger foot 80. The device 10 is static resistant because of the rubber wheels 55, 56 attached to the base 30, and rubber pads (not shown) attached to the outrigger feet 80. While four wheels, or pairs of wheels, have been shown and described, other arrangements are contemplated. For example, the device 10 could have three wheels or two wheels and one leg.

There are several other features of the device 10. The frame 33 may have a handle 84 on the front for easy transportation. The base 30 conveniently has a detachable seat (not shown) and a detachable canopy (not shown) which can be mounted on either side of the frame 33. A high speed camera (not shown) may also be mounted on the frame 33. The pole 13 is easily removed from the base 30 for easy storage of the device 10. A fire extinguisher (not shown) may be mounted on clips 28, 29, or carried on the platform 34.

An alternative use of this embodiment of the present invention is to plug an extension cord into the battery 20, while the rest of the mechanism sits in a transporting vehicle (not shown). One may take the pole 13 and use it directly from the transporting vehicle.

A remote control allows the pole 13 to be rotated between positions; such as one where "STOP" on sign 11 faces oncoming traffic and another where "SLOW" faces oncoming traffic. For this purpose a motorized remote control includes a servo motor 72 that is mounted on the base 30 adjacent to the supporting hub 32 and a control switch 74 operatively connected to the servo motor via line 75. The electronics 90 associated with the servo motor 72 are advantageously located on a side of the battery case 36, so that the top of the battery case 36 may be used as a step for an operator. A preferred embodiment of the remote control includes a gear (not shown) on the servo motor 72 that drives a chain 86 that drives another gear 77 located circumjacent the pole supporting hub 32. Operation of the servo motor 72 will rotate the sign 11.

It is now deemed apparent that a lighted sign and warning device 10 has been described which has a number of advantages and features, including a light 12 which is reflected both outwardly toward oncoming traffic and downwardly to illuminate the sign 11.

While a preferred method of practicing the invention has herein been illustrated and described, this has been done by way of illustration and not limitation, and the invention should not be limited except as required by the scope of the appended claims.

What is claimed is:

1. A lighted traffic sign including:

a sign having a top;

a strobe light having a housing mounted at the top of the sign, the housing having a reflector, the reflector directing light from the lighting device outwardly and downwardly onto the sign;

a base;

at least one wheel mounted to the base; and a pole mounted on the base supporting the sign.

2. A lighted traffic sign in accordance with claim 1, wherein the sign includes at least one face.

3. A lighted traffic sign in accordance with claim 1, wherein the lighting device is at least one strobe light.

4. A lighted traffic sign in accordance with claim 3, wherein the strobe light is a quad flashing strobe light.

5. A lighted traffic sign in accordance with claim 1, wherein the lighting device is encased in an omnidirectional housing.

6. A lighted traffic sign in accordance with claim 5, wherein the sign and lighting device are encased in one housing.

7. A lighted traffic sign in accordance with claim 5, wherein the lighting device is encased in a removable housing.

8. A lighted traffic sign in accordance with claim 1, wherein the lighting device is powered by a source of direct current electricity.

9. A lighted traffic sign in accordance with claim 8, wherein the lighting device is powered by a solar cell.

10. A lighted traffic sign in accordance with claim 1, wherein the lighting device is powered by a source of alternating current electricity.

11. A lighted traffic sign in accordance with claim 1, wherein a camera is mountable onto the base.

12. A lighted traffic sign in accordance with claim 1, wherein at least one outrigger is operatively connected to the base.

13. A lighted traffic sign in accordance with claim 12, further including at least one outrigger foot on each outrigger.

14. A lighted traffic sign in accordance with claim 13, wherein the outrigger foot is connected to the outrigger with a swivel.

15. A lighted traffic sign in accordance with claim 13, wherein the outrigger feet is manually adjustable.

16. A lighted traffic sign in accordance with claim 13, wherein the outrigger feet are so constructed and arranged to be adjustable by a drill.

17. A lighted traffic sign in accordance with claim 1, wherein the base is static resistant.

18. A lighted traffic sign in accordance with claim 1, wherein at least one of the wheels mounted to the base is self-locking.

19. A lighted traffic sign in accordance with claim 1, wherein the pole mounted on the base supporting the sign is movable between a raised and lowered position.

20. A lighted traffic sign in accordance with claim 19, further including a remote control in functional communication with the pole, whereby the pole is rotated from a remote location.

21. A lighted traffic sign in accordance with claim 1, wherein the pole mounted on the base supporting the sign is rotatable.

22. A lighted traffic sign in accordance with claim 21, wherein the remote control includes a servo motor that is mounted on the base near a supporting hub and a control switch in functional communication with the servo motor, whereby a gear on the servo motor drives a chain that drives a gear circumjacent the pole to rotate the sign.

23. A lighted traffic sign in accordance with claim 1, further including a seat mounted on the base.

24. A lighted traffic sign in accordance with claim 1, further including a means for shading in functional communication with the seat.

* * * * *

UNITED STATES PATENT AND TRADEMARK OFFICE

CERTIFICATE OF CORRECTION

PATENT NO. : 6,150,957
DATED : November 21, 2000
INVENTOR(S) : Richard M. Heinz and Phillip C. Layne It is certified that error appears in the above-identified patent and that said Letters Patent is hereby corrected as shown below:

Title page,
Please cancel the Inventor's name "Richard M. Henz" and insert -- Richard M. Heinz --

Signed and Sealed this

Eleventh Day of December, 2001

*Attest:*

Nicholas P. Godici

NICHOLAS P. GODICI
*Acting Director of the United States Patent and Trademark Office*

*Attesting Officer*